US012507840B2

(12) United States Patent
Kullman et al.

(10) Patent No.: US 12,507,840 B2
(45) Date of Patent: Dec. 30, 2025

(54) DISPENSER FOR DISPENSING WEB MATERIAL FROM A ROLL

(71) Applicant: Essity Hygiene and Health Aktiebolag, Gothenburg (SE)

(72) Inventors: Marcus Kullman, Borlänge (SE); Martina Johansson, Borlänge (SE); Johanna Enmalm, Borlänge (SE); Mattias Bengtsson, Gothenburg (SE); Tomas Gandemo, Gothenburg (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 725 days.

(21) Appl. No.: 17/614,688

(22) PCT Filed: Jul. 5, 2019

(86) PCT No.: PCT/EP2019/068083

§ 371 (c)(1),
(2) Date: Nov. 29, 2021

(87) PCT Pub. No.: WO2021/004603

PCT Pub. Date: Jan. 14, 2021

(65) Prior Publication Data

US 2022/0225849 A1 Jul. 21, 2022

(51) Int. Cl.
*A47K 10/40* (2006.01)
*A47K 10/32* (2006.01)

(52) U.S. Cl.
CPC ..... *A47K 10/40* (2013.01); *A47K 2010/3233* (2013.01)

(58) Field of Classification Search
CPC ..... A47K 10/40; A47K 2010/3233; A47K 2010/3206; A47K 10/3687; B65H 16/04; B65H 75/245

(Continued)

(56) References Cited

U.S. PATENT DOCUMENTS 2,809,790 A * 10/1957 Kirchel ..... G01D 15/28 242/596.3
2,930,664 A * 3/1960 Liebisch ..... A47K 10/3656 242/564.2

(Continued)

FOREIGN PATENT DOCUMENTS

CN 106455874 A 2/2017
DE 19545440 A1 6/1997

(Continued)

OTHER PUBLICATIONS

International Preliminary Report on Patentability (PCT/IPEA/409) issued on Oct. 5, 2021, by the European Patent Office as the International Searching Authority for International Application No. PCT/EP2019/068083.

(Continued)

*Primary Examiner* — Rakesh Kumar
(74) *Attorney, Agent, or Firm* — BUCHANAN INGERSOLL & ROONEY PC

(57) ABSTRACT

Dispenser for dispensing web material from a roll, the dispenser including a housing defining an interior of the dispenser and an arm hinged at a hinge point to a support member. The arm is adapted to pivot about the hinge point. The dispenser further includes a spindle attached perpendicular to the arm. The spindle is adapted to rotatably support a roll during dispensing. The arm is pivotable between a first position in which the spindle is arranged in a dispensing position within the housing of the dispenser and a second position in which the spindle is arranged in a loading position outside the housing of the dispenser in order to allow loading of a roll onto the spindle.

26 Claims, 10 Drawing Sheets

(58) Field of Classification Search
USPC ..... 221/1
See application file for complete search history.

(56) References Cited

U.S. PATENT DOCUMENTS 3,007,650 A * 11/1961 Burton ..... A47K 10/36 312/34.19
3,050,224 A * 8/1962 Drolshammer ..... A47K 10/38 225/88
3,126,234 A * 3/1964 Batlas ..... A47K 10/32 242/596.7
3,184,176 A * 5/1965 Tucker ..... A47K 10/38 242/560
3,276,706 A * 10/1966 House ..... A47K 10/38 226/110
3,288,387 A * 11/1966 Craven, Jr. ..... A47K 10/3687 242/560.1
3,628,743 A * 12/1971 Bastian ..... A47K 10/32 242/560.1
3,917,191 A * 11/1975 Graham, Jr. ..... A47K 10/36 242/596.4
4,010,909 A * 3/1977 Bastian ..... A47K 10/3687 226/91
4,034,924 A * 7/1977 Carlisle ..... A47K 10/40 242/560.3
4,067,509 A * 1/1978 Graham, Jr. ..... A47K 10/36 242/560.1
4,106,684 A * 8/1978 Hartbauer ..... A47K 10/3637 226/110
4,122,738 A * 10/1978 Granger ..... A47K 10/3643 83/191
4,137,805 A * 2/1979 DeLuca ..... A47K 10/3687 226/110
4,148,442 A * 4/1979 Baumann ..... B65H 19/10 242/560.1
4,165,138 A * 8/1979 Hedge ..... A47K 10/3656 242/564.4
4,260,117 A * 4/1981 Perrin ..... A47K 10/3687 242/564.2
4,264,403 A * 4/1981 Emmel ..... B65C 11/00 156/154
4,307,638 A * 12/1981 DeLuca ..... A47K 10/3643 83/345
4,317,547 A * 3/1982 Graham, Jr. ..... A47K 10/3687 242/560.1
4,358,169 A * 11/1982 Filipowicz ..... A47K 10/3637 225/8
4,367,666 A * 1/1983 Toth ..... B65H 35/08 83/272
4,378,912 A * 4/1983 Perrin ..... A47K 10/3637 226/91
4,487,375 A * 12/1984 Rasmussen ..... A47K 10/40 226/174
4,535,947 A * 8/1985 Hidle ..... A47K 10/38 242/596.7
4,552,315 A * 11/1985 Granger ..... A47K 10/3643 242/560.3
4,600,162 A * 7/1986 Hidle ..... A47K 10/38 242/129.51
4,691,503 A * 9/1987 Frerich ..... B65B 41/12 53/118
4,756,485 A * 7/1988 Bastian ..... A47K 10/3687 242/560.1
4,807,824 A * 2/1989 Gains ..... A47K 10/3687 242/560.1
4,846,412 A * 7/1989 Morand ..... A47K 10/3687 225/106
5,161,723 A * 11/1992 Wirtz-Odenthal ..... A47K 10/3687 225/14
5,244,161 A * 9/1993 Wirtz-Odenthal ..... A47K 10/3687 242/563.2
5,271,574 A * 12/1993 Formon ..... A47K 10/36 242/560.3
5,292,083 A * 3/1994 Ridenour ..... A47K 10/40 242/596.3
5,294,192 A * 3/1994 Omdoll ..... A47K 10/3687 242/564.4
5,314,131 A * 5/1994 McCanless ..... A47K 10/3836 242/559
5,370,336 A * 12/1994 Whittington ..... A47K 10/3836 242/599.4
5,400,982 A * 3/1995 Collins ..... A47K 10/36 242/564.4
5,604,992 A * 2/1997 Robinson ..... A47K 10/485 242/560
5,758,843 A * 6/1998 Ongaro ..... A47K 10/3836 242/563.2
5,813,624 A * 9/1998 Grasso ..... A47K 10/3836 242/560
5,868,342 A * 2/1999 Moody ..... A47K 10/38 242/598.6
5,915,645 A * 6/1999 Granger ..... A47K 10/3687 242/560
5,954,256 A * 9/1999 Niada ..... A47K 10/3836 242/598.6
6,036,134 A * 3/2000 Moody ..... A47K 10/3836 242/596.7
6,098,919 A * 8/2000 Lewis ..... A47K 10/40 242/596.7
6,145,779 A * 11/2000 Johnson ..... A47K 10/3687 242/564.2
6,152,397 A * 11/2000 Purcell ..... A47K 10/3687 242/563.2
6,202,956 B1 3/2001 Grasso et al.
6,224,010 B1 * 5/2001 Morand ..... A47K 10/3687 242/564.2
6,517,025 B1 * 2/2003 Budz ..... A47K 10/3818 242/563
6,585,344 B2 * 7/2003 Kolodziej ..... B65H 1/12 271/265.04
6,736,348 B1 * 5/2004 Formon ..... A47K 10/3687 242/563
6,752,349 B2 6/2004 Moody et al.
7,083,138 B2 * 8/2006 Elliott ..... A47K 10/3836 242/597.5
7,185,843 B1 * 3/2007 Li ..... A47K 10/40 242/596.4
7,354,015 B2 * 4/2008 Byrd ..... A47K 10/36 242/563
7,793,882 B2 * 9/2010 Reinsel ..... A47K 10/36 242/563.2
7,841,556 B2 * 11/2010 Elliott ..... A47K 10/3687 242/564.2
7,878,444 B2 * 2/2011 Friesen ..... A47K 10/3687 242/561
8,146,471 B2 * 4/2012 Hansen ..... A47K 10/3643 83/337
8,282,033 B2 * 10/2012 Achton ..... A47K 10/3687 242/560.1
8,366,035 B2 * 2/2013 Kling ..... B65H 7/04 242/606
8,610,536 B2 * 12/2013 Libby ..... B67D 1/0888 340/541
9,648,994 B2 * 5/2017 Cattacin ..... A47K 10/3827
10,682,023 B2 * 6/2020 Holden ..... A47K 10/3836
11,324,361 B2 * 5/2022 Ziebart ..... A47K 10/38
2003/0025030 A1 * 2/2003 Granger ..... A47K 10/3643 242/596.3
2004/0090332 A1 * 5/2004 Morello ..... G07F 19/201 340/572.8
2005/0051663 A1 3/2005 Walters
2006/0032862 A1 * 2/2006 Miller ..... B67D 7/22 222/64
2006/0217820 A1 * 9/2006 Holt ..... A47K 10/40 700/46
2006/0236832 A1 * 10/2006 Cvjetkovic ..... A47K 10/38 83/337

(56) References Cited

U.S. PATENT DOCUMENTS

| | | | | |
|---|---|---|---|---|
| 2007/0010389 | A1* | 1/2007 | Cutrona | A47K 10/3643 83/337 |
| 2007/0278334 | A1* | 12/2007 | Granger | A47K 10/3656 242/172 |
| 2009/0057169 | A1* | 3/2009 | Kruchoski | A47K 10/40 242/599.1 |
| 2009/0057456 | A1* | 3/2009 | Shannon | A47K 10/16 242/160.1 |
| 2010/0044407 | A1* | 2/2010 | Yardley | B65H 35/0006 225/14 |
| 2010/0111586 | A1* | 5/2010 | Kawabe | B41J 15/042 400/613 |
| 2010/0202817 | A1* | 8/2010 | Shishido | B41J 15/042 242/558 |
| 2011/0114782 | A1* | 5/2011 | Rodrian | A47K 10/36 700/243 |
| 2012/0256036 | A1* | 10/2012 | Osborne | A47K 10/3662 242/560 |
| 2013/0099924 | A1* | 4/2013 | Larsson | G08B 21/182 428/411.1 |
| 2014/0367401 | A1* | 12/2014 | Stralin | A47K 10/38 221/6 |
| 2015/0097068 | A1* | 4/2015 | Larson | A47K 10/22 242/563 |
| 2015/0374182 | A1 | 12/2015 | Delaney | |
| 2016/0037979 | A1* | 2/2016 | Mattheeussen | A47K 10/38 242/422.1 |
| 2016/0137398 | A1* | 5/2016 | Lemke | B65D 77/02 206/391 |
| 2016/0187484 | A1* | 6/2016 | Bloomfield | B65H 23/1825 250/341.8 |
| 2017/0057775 | A1* | 3/2017 | Kobs | A47K 10/3625 |

FOREIGN PATENT DOCUMENTS

| | | | |
|---|---|---|---|
| JP | H077588 | U | 2/1995 |
| WO | 9803108 | A1 | 1/1998 |

OTHER PUBLICATIONS

International Search Report (PCT/ISA/210) with translation and Written Opinion (PCT/ISA/237) mailed on Mar. 12, 2020, by the European Patent Office as the International Searching Authority for International Application No. PCT/EP2019/068083.

Written Opinion of the International Preliminary Examining Authority (PCT/IPEA/408) issued on May 28, 2021, by the European Patent Office as the International Searching Authority for International Application No. PCT/EP2019/068083.

Notification of the First Office Action issued on Jul. 1, 2022 by the Chinese Patent Office in corresponding Chinese Patent Application No. 201980096590.3, and an English Translation of the Office Action. (20 pages).

Office Action issued on Apr. 13, 2022, by the Indian Patent Office in corresponding Indian Patent Application No. 202117054016. (7 pages).

Office Action (Patent Examination Report No. 1) issued on Sep. 11, 2023, in corresponding New Zealand Patent Application No. 782656. (6 pages).

Office Action (Examination report No. 1 for Standard patent application) issued Oct. 6, 2022, by the Australian Government, IP Australia in corresponding Australian Patent Application No. 2019456174. (3 Pages).

Office Action (Notification of the 2nd Office Action) issued Jan. 3, 2023, by the National Intellectual Property Administration, P. R. China in corresponding Chinese Patent Application No. 201980096590.3 and an English X Translation of the Office Action. (15 pages).

Communication pursuant to Article 94(3) EPC dated Feb. 24, 2025, by the European Patent Office in corresponding European Patent Application No. 19 736 701.4-1005 (6 pages).

* cited by examiner

DISPENSER FOR DISPENSING WEB MATERIAL FROM A ROLL

TECHNICAL FIELD

Dispenser for dispensing web material from a roll, the dispenser comprising a housing defining an interior of the dispenser and an arm hinged at a hinge point to a support member. The arm is adapted to pivot about the hinge point. The dispenser further comprises a spindle attached perpendicular to the arm. The spindle is adapted to rotatably support a roll during dispensing.

BACKGROUND

Various types of dispensers for dispensing tissue paper from rolls are known in the art. In public restrooms the roll dispensers commonly comprise a housing to protect the roll from contamination and the tissue paper is accessible through a dispensing opening in housing. Typically, a front cover is openable which allows the service personnel to access the interior of the dispenser for loading the roll of tissue paper. Dispensers intended for coreless roll dispensing comprise a spindle for holding the roll during dispensing. In one common type of dispenser the dispensing opening is arranged in the front cover of the dispenser, and the spindle is arranged parallel to the back wall of the dispenser such that the face of the tissue paper roll face the dispensing opening. Such dispensers are sometimes large and bulky in order to allow access to the spindle when the front cover is opened to allow loading of new refills.

Loading dispensers is an important part of the maintenance personnel's tasks but is sometimes cumbersome and requires many steps. In addition, correct loading of rolls of tissue paper in order to make sure tissue paper is readily available for the end-user is not always easily achieved.

SUMMARY

The dispenser disclosed herein aim to overcome the above mentioned issues with existing dispensers, and aims to fulfill the desires of a functional dispenser that is easy to load without being too bulky. The disclosure further provides a method of loading a roll onto such a dispenser.

Further advantages are achieved by implementing one or several of the features described herein.

The disclosure relates to a dispenser for dispensing web material from a roll, the dispenser comprising a housing defining an interior of the dispenser, an arm hinged at a hinge point to a support member, the arm being adapted to pivot about the hinge point and a spindle attached perpendicular to the arm, the spindle being adapted to rotatably support a roll during dispensing. The arm is pivotable between a first position, in which the spindle is arranged in a dispensing position within the housing of the dispenser, and a second position, in which the spindle is arranged in a loading position outside the housing of the dispenser in order to allow loading of a roll onto the spindle. The hinge point allows the arm to pivot between the first and second position, thereby moving the spindle between loading and dispensing position.

The roll may be a coreless roll. The spindle may be provided with a sleeve facilitating the coreless roll to rotate about the spindle. The web material may be tissue paper. In one example the tissue paper is toilet tissue paper.

The arm may be folded over the support member in first position, and folded away from the support member in second position. The arm may comprise one or more spindles.

Folding of the arm over the support member in first position and folding it out to a second position for loading saves space and the dispenser may be made more compact.

The arm may be pivotable from the first position within the interior of the dispenser into the second position allowing loading of a roll onto the spindle. The second position is placing the spindle in loading position outside of the interior of the dispenser such that the service personnel is able to load a new refill roll onto the spindle. The first end of the spindle, being the non-attached end, should thus be accessible for receiving a refill roll in loading position.

The housing may further comprise a back wall and at least two side walls. The back wall of the dispenser is adapted to be fastened to a wall during use of the dispenser.

Since the spindle is attached perpendicular to the arm it extends in horizontal direction parallel to the back wall of the dispenser.

The support member may be attached to the dispenser at a side wall of the dispenser. The support member and the arm extend in a direction perpendicular from the back wall of the dispenser, and the arm is configured to pivot in same direction. The arm thus pivots outwards from the interior of the housing providing access to a first end of the spindle from the side which facilitates loading of the dispenser.

The spindle in dispensing position is arranged closer to the back wall of the dispenser housing than the hinge point, i.e. the axis of rotation of the arm. This means that the arm is folded over the hinge point into its first position so that the spindle, when in dispensing position, is arranged closer to the back wall of the dispenser than the hinge point itself. The attraction of gravity of the arm in first position and spindle in dispensing position is located beyond the axis of rotation, towards the back of the dispenser, thereby allowing the spindle to rest in dispensing position. The spindle will only move towards loading position upon an action from the service personnel; i.e. folding the arm forward towards its second position. The hinge point is hence arranged closer to the back wall of the dispenser than the spindle in loading position with the arm folded outwards in its second position.

The angle between the spindle in loading position and the spindle in dispensing position may be at least 90 degrees, preferably at least 110 degrees and more preferably at least 130 degrees.

A deflecting member is arranged in the dispenser housing, the deflecting member being arranged to receive a first end of the spindle when the spindle is in dispensing position. The deflecting member may comprise a guiding groove adapted to receive the first end of the spindle and guide it into an engaged position when the arm is in dispensing position. The guiding groove thereby stabilizes the spindle in dispensing position during dispensing of web material from a roll disposed on the spindle. The deflecting member may be arranged closer to the back wall of the dispenser housing than the hinge point and axis of rotation of the arm.

The deflecting member may be movable between a protruding position in which the deflecting member is protruding towards the spindle in dispensing position and a retracted position in which the deflecting member is retracted into the housing away from the spindle in dispensing position. The deflecting member may be connected to a blocking member moving in response to the movement of the deflecting member.

The deflecting member may be movable between its two positions in response to a roll being loaded in the dispenser on the movable spindle. The deflecting member may move into retracted position when a force is applied to it and may be arranged such as to come into contact with a roll arranged on the spindle as the spindle moves between loading and dispensing position. The deflecting member may stay in retracted position as long as a roll arranged on the spindle in dispensing position exerts a force onto the deflecting member.

The deflecting member may interact with a resilient member arranged to allow the deflecting member to flex back into protruding position from retracted position. The resilient member is in relaxed state when the deflecting member is in its protruding position. The deflecting member moves into retracted position when a force is applied to it, thereby forcing the resilient member to tense state. Once the tension applied to the deflecting member is removed the resilient member relaxes and moves the deflecting member back into protruding position. The resilient member connects the deflecting member to the housing of the dispenser.

The blocking member may be movable in a direction perpendicular to the movement of the deflecting member. The movement is translated by means of a connection member translating a horizontal movement of the deflecting member into vertical movement of the blocking member. The connection member connects the blocking member to the deflecting member. The blocking member is arranged in a blocking position when the deflecting member is in its retracted position. The blocking member in blocking position hinders the dispenser from functioning as intended, i.e. it hinders proper loading and dispensing.

The deflecting member may have a shape adapted to fit in a complementary indentation in the side of a roll arranged on the spindle. The shape may be at least partly frustoconical. The deflecting member is adapted to be pushed into the retracted position in the dispenser housing when coming into contact with a side of a roll comprising an indentation complementary to the shape of the deflecting member as the spindle is moved into dispensing position, and the deflecting member being adapted to flex back into protruding position when the spindle reaches dispensing position in which the first end of the spindle is in engaged position. As a result, only rolls with an indentation having a shape which is complementary to the shape of the deflecting member allows the deflecting member to flex back into protruding position and subsequently moves the blocking member out of blocking position. If a roll which does not have an indentation of complementary shape is placed in dispensing position the deflecting member remains in retracted position, and the blocking member remains in blocking position. The front cover of the dispenser can not stay in closed state with such a roll in dispensing position. Hence, this allows the service personnel to detect that a roll is faulty loaded before walking away from the dispenser, and the issue can be corrected before it affects the end-user of the dispenser.

The dispenser may comprise a front cover and the front cover is hinged to the dispenser housing below the hinge point of the arm and movable between an opened and closed state, the front cover being adapted to be opened forward downwards when the dispenser is mounted on a wall and wherein the front cover, upon being moved from opened to closed state, is adapted to abut against the arm if the arm is in second position and push the arm towards the first position with the movement of the front cover. Hence, the arm is moved from second position to first position upon closing the front cover so that the user, after loading a new roll onto the spindle in dispensing position, does not have to first fold the arm and spindle and then close the front cover in two separate actions. The positioning of the spindle in dispensing position may be done by simply closing the front cover.

The arm may comprise an overload mechanism allowing the arm to snap out of second position and rotate further about the hinge point if a force above a predetermined release force is applied to the spindle when the arm is in second position. The release force is a vertical force measured at the second end of the spindle, where the spindle is attached to the arm. The release force is set such that the overload mechanism is triggered before the force needed to break the spindle from arm is reached, i.e. the overload mechanism allows the arm to snap out of second position, into a third position, instead of the spindle breaking off from the attachment to the arm when a force above a predetermined release force is applied to it. The overload mechanism thus minimizes the risk of the spindle being unusable if a force above the predetermined release force is applied to the arm or spindle, e.g. during movement of the arm between first and second position or during loading of the spindle. The arm is allowed to snap back into second position again once the force is removed, without any parts of the dispenser being damaged.

The arm may partly encompass part of the support member when the arm is in first position. This enables the arm to fold over the support member and overlap it in first position. The arm may comprise two bearing surfaces, the bearing surfaces bear against the outer side surfaces of the support member such that the bearing surfaces are allowed to slide against the outer side surfaces of the support member when the arm moves between first position and second position. The surfaces bearing against each other as the arm folds between its two positions provides stability during the fold movement, and also allows the arm to encompass part of the support member in its first, folded over, position. At least one outer side surface of the support member may be provided with a knob or recess and at least the corresponding bearing surfaces of the arm is provided with a complementary recess or knob, wherein the knob is allowed to slide along the recess as the arm moves between first position and second position.

This further stabilizes the movement between first and second position. The recess(es) may comprise closed end positions between which the knob(s) are allowed to move, the closed end points defining the first and second position of the arm. The knob(s) are intended to snap out of the recess(es) if a force above a predetermined release force is applied to the spindle when the arm is in second position. This overload mechanism hinders the arm in second position to break off from the support member, or the spindle to break off from the arm if heavy weight is placed on it.

The dispenser may be a dual dispenser comprising two support members, two arms and two spindles adapted to hold a roll respectively, and wherein the two arms are movable between first position and second position independent of each other. Each of the two spindles are attached to an arm respectively. Hence, the two spindles are movable between loading position and dispensing position independently from each other so that loading of a new roll on one spindle can be done irrespective of the other spindles position which allows for loading flexibility.

The two spindles of the dual dispenser may be arranged side-by-side in the dispenser. The dispensing opening in the front cover of the dispenser is arranged such that it provides access to both spindles in dispensing position, i.e. access to both rolls when arranged in the dispenser, and may be provided with a lid movable between two positions such as to cover either one of the rolls arranged on the spindles in dispensing position so that only one roll at the time is accessible for dispensing.

The housing of the dual dispenser may comprise a central side wall arranged between the two spindles, a deflecting member being arranged in the central side wall protruding from the central side wall towards one of the spindles in dispensing position in its protruding position and the deflecting member retracted into the housing away from the spindle in dispensing position in its retracted position. A first spindle is arranged to protrude from a first side wall, via an arm, such that the first end of the first spindle interacts with a deflecting member arranged in the central side wall. The second spindle is arranged to extend from the central side wall, via an arm, such that the first end of the second spindle interacts with a receiving part at the second side wall opposite the first side wall. The receiving part may or may not comprise a deflecting member. The receiving part may have the same shape as the deflecting member such that the receiving part fits in an indentation in a roll, the indentation being complementary to the shape of the deflecting member.

In another non-limiting example the dispenser may be a dual dispenser comprising a support member, an arm and two spindles adapted to hold a roll respectively; the two spindles being attached perpendicular to the same arm. The two spindles may either be arranged to extend in opposite direction in respect to each other from the outer non-hinged end of the arm, allowing side-by-side positioning of two rolls, or extend parallel in respect to each other along the extension of the arm. Hence, the two spindles are movable between loading position and dispensing position simultaneously.

The disclosure also discloses a method of loading a dispenser for dispensing web material from a roll, the dispenser comprising a housing, an arm hinged at a hinge point to a support member, the arm being allowed to pivot about the hinge point and the dispenser further comprising a spindle attached perpendicular to the arm, the spindle being adapted to rotatably support a roll during dispensing. The method of loading comprises the steps of pivoting the arm to a second position in which the spindle is arranged in a loading position outside the housing of the dispenser thereby allowing loading of a roll onto the spindle, placing a roll on the spindle, and pivoting the arm back into a first position in which the spindle is arranged in a dispensing position within the housing of the dispenser.

The arm may be folded away from the support member when pivoted to the second position, and the arm is folded back towards the support member when pivoted into the first position.

The method may further comprise moving the front cover to the opened state before pivoting the arm into a loading position, moving the front cover from the opened state to the closed state after a roll has been placed on the spindle, and pushing the front cover against the arm in second position, the arm thereby being urged to fold towards the first position with the movement of the front cover.

BRIEF DESCRIPTION OF THE FIGURES

The disclosure herein presented is illustrated by way of examples and not limited to the accompanying drawings, in which like references indicate similar elements.

DETAILED DESCRIPTION

It is to be understood by one of ordinary skill in the art that the following is a description of exemplary embodiments only, and is not intended as limiting the broader aspects of the present disclosure.

Figure 1A:
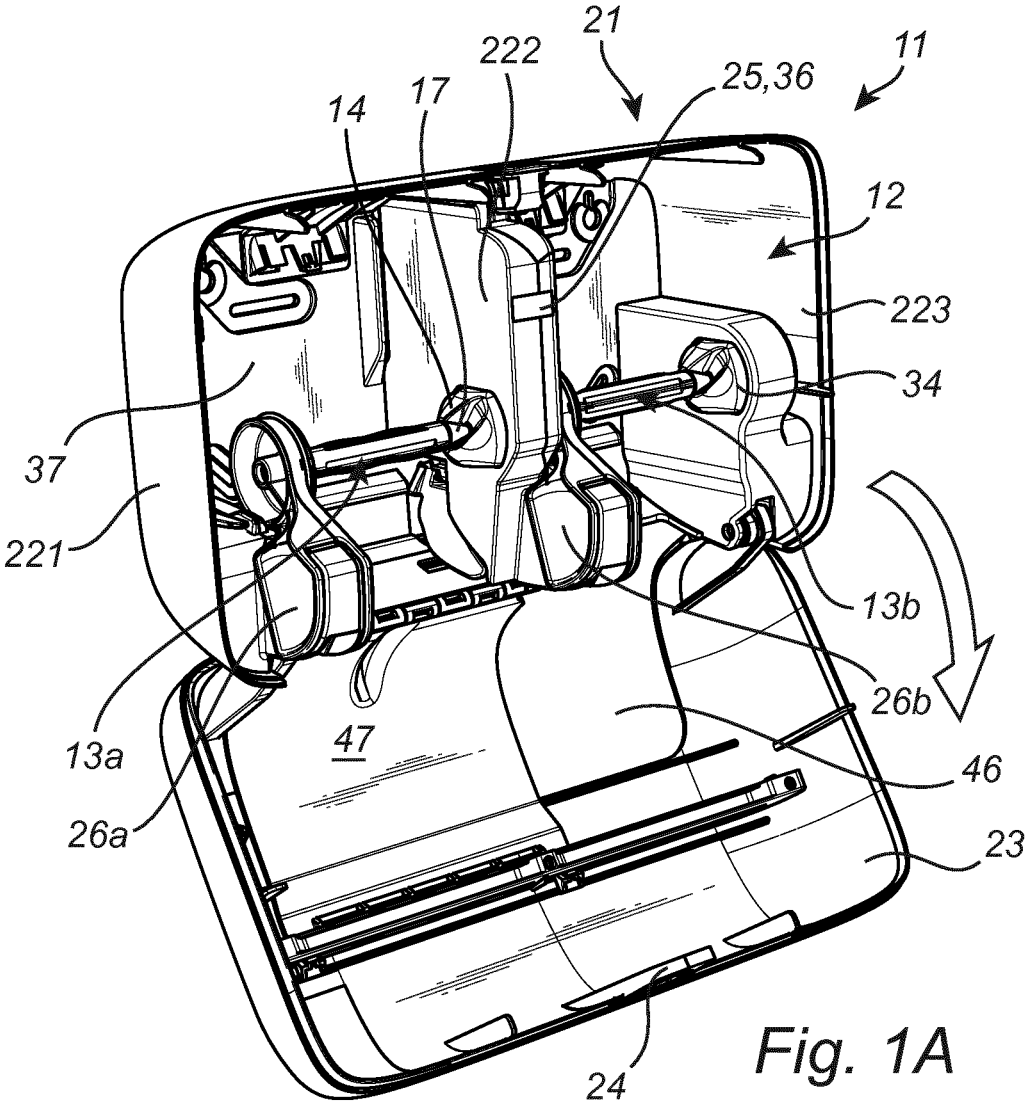
FIG. 1A is a perspective view of the dispenser disclosed herein, with both spindles in dispensing position.

FIG. 1A shows a dual dispenser 11 comprising a housing 12 defining an interior. The housing 12 comprises a back wall 37, a top wall 21, two outer side walls 221, 223 and a central side wall 222. A first and a second arm 26*a*, 26*b* is hinged at a respective hinge point 27 to a respective support member 28*a*, 28*b*, and the arms 26*a*, 26*b* are adapted to pivot about the hinge points 27. The first arm 26*a* is hinged at a first support member 28*a* arranged close to the first side wall 221, at the lower part of the back wall 37. The second arm 26*b* is hinged to a second support member 28*b* arranged at the lower part of the central side wall 222. The support members 28*a*, 28*b* and the arms 26*a*, 26*b* extend in a direction perpendicular from the back wall 37 of the dispenser 12, and the arms 26*a*, 26*b* are adapted to pivot in same direction. Each arm 26*a*, 26*b* is provided with a spindle 13*a*, 13*b*, the spindles 13*a*, 13*b* being attached perpendicular to respective arm 26*a*, 26*b*, and the spindles 13*a*, 13*b* being adapted to rotatably support a roll during dispensing. Each spindle 13*a*, 13*b* is provided with a rotatable sleeve 32. In FIG. 1A, the rotatable sleeves 32 are intended to interact with rolls disposed on the spindles 13*a*, 13*b*, allowing the rolls to rotate during dispensing of the web material from the roll.

The first spindle 13*a*, being attached to the first arm 26*a*, has a first end 17 directed towards the central side wall 222, and a second end 33 attached to the first arm 26*a*. The second spindle 13*b*, being attached to the second arm 26*b*, has a first end 17 directed towards the second side wall 223 and a second end 33 attached to the second arm 26*b*.

Figure 1B:
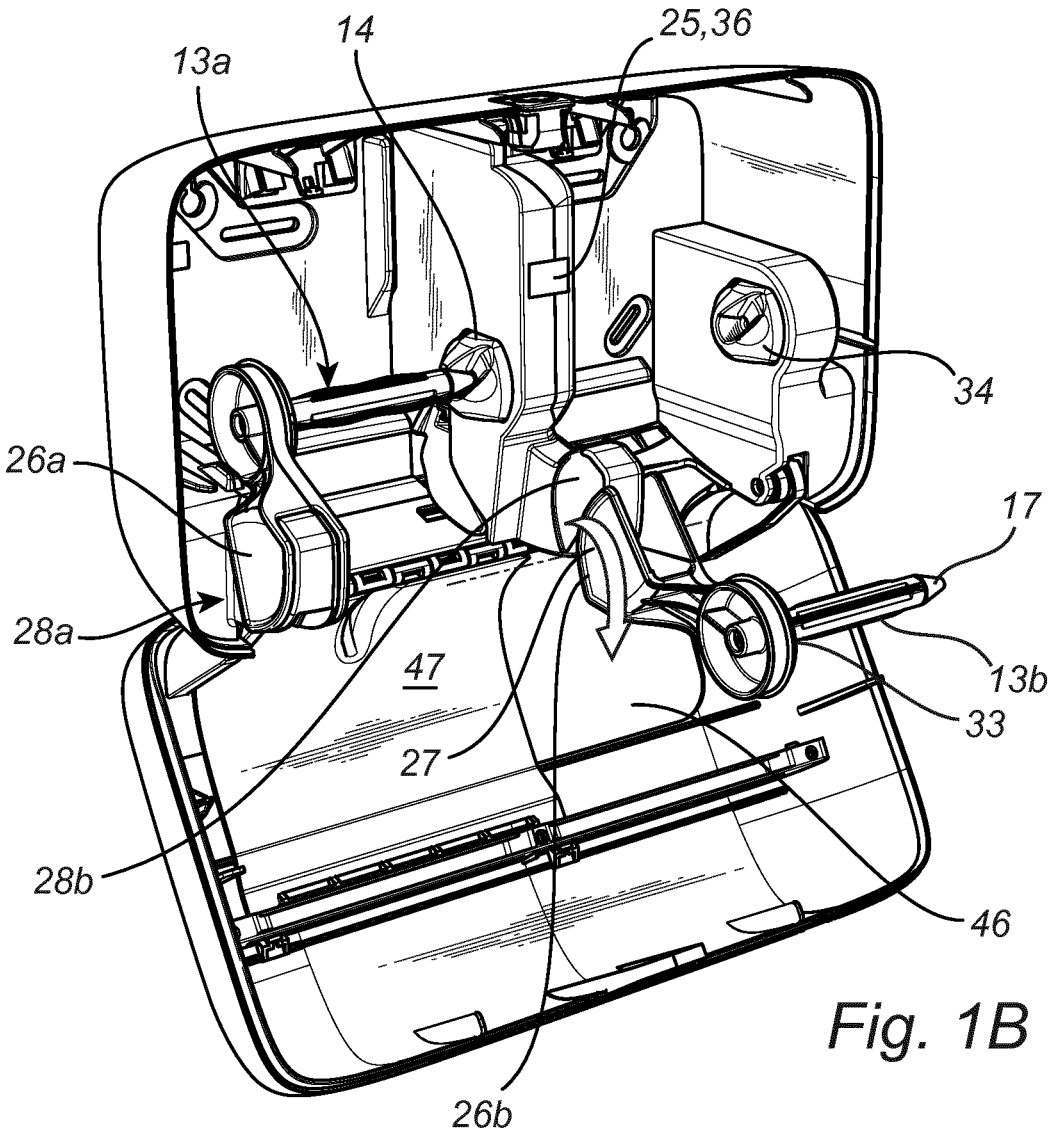
FIG. 1B is a perspective view of the dispenser disclosed herein, with a first spindle in dispensing position and a second spindle in loading position.

The spindles 13*a*, 13*b* are movable between a dispensing position and a loading position respectively by means of the arms 26*a*, 26*b*. Each respective arm 26*a*, 26*b* has a spindle dispensing position in which the spindle 13*a*, 13*b* is arranged within the housing 12 of the dispenser 11, shown in FIG. 1A, and a spindle loading position in which the spindle 13*a*, 13*b* is arranged outside the housing 12 of the dispenser 11 in order to allow loading of a roll onto the spindle 13*a*, 13*b*, shown in FIG. 1B (second spindle 13*b*). The arms 26*a*, 26*b* are pivotable to place each respective spindle 13*a*, 13*b* in the two positions respectively, and the arms 26*a*, 26*b* are pivotable independently from each other, as shown in FIG. 1B. Hence, the spindles 13*a*, 13*b* are movable between loading position and dispensing position independent from each other.

A front cover 23 is hinged at to the lower parts of the outer side walls 221, 223, i.e. at the lower part of the dispenser 11. The front cover 23 is movable between an opened state, shown in FIGS. 1A and 1B, and a closed state (not shown). An engagement member 24 in the shape of a locking hook is arranged at the top of the front cover 23 in a central position corresponding to the central side wall 222 when the front cover 23 is in closed state. The front cover 23 has a dispensing opening 46 and a slidable lid 47 covering one half of the dispensing opening 46 at the time. The slidable lid 47 is slidable between two positions so that one roll at the time, arranged on the spindles 13*a*, 13*b*, are available for dispensing when the front cover 23 is in closed state.

If the front cover 23 is closed with the second arm 26*b* in loading position, as shown in FIG. 1B, the front cover will abut the arm 26*b* and push it upwards and inwards such that it folds over the support member 28*b* from a first position into a second position; placing the spindle 13*b* in dispensing position within the interior of the housing 12.

Figure 2A:
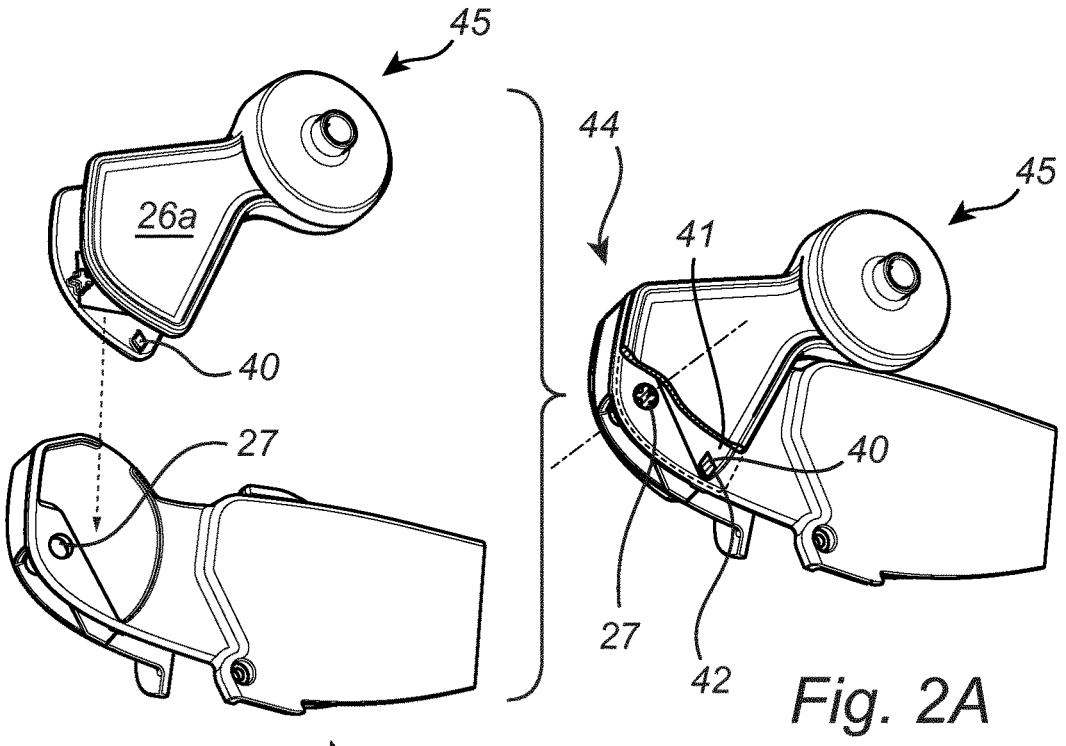
FIGS. 2A-E is a perspective view of the first arm in first, second and third position respectively.

FIGS. 2A-C and 2E shows the first arm 26*a* attached to a first support member 28*a* at a pivot point. The pivot point 27 is arranged at a first end 44 of the first arm 26*a*. In FIG. 2A the arm is folded at the pivot point 27 such that it partly encompasses the first support member 28*a*, i.e. the first arm 26*a* is in its first position and the first spindle 13*a* is in dispensing position. The first arm 26*a* comprises two legs 43 with a respective inner bearing surface 39. The two legs 43 are attached at the pivot point 27 to outer side surfaces 38 of the support member 28*a*, such that the bearing surfaces 39 of the first arm 26*a* bear against the outer side surfaces 38 of the support member 28. The first spindle 13*a* is attached at a second end 45 of the first arm 26*a* opposite the first end 44 comprising the legs 43 and pivot point 27. When the arm 26*a* is in its first position the spindle 13*a* in its dispensing position is arranged closer to the back wall 37 of the dispenser 11 than the hinge point 27 of the first arm 26*a*. In other words, the first arm 26*a* has been folded backwards over the first support member 28*a* and into the housing 12.

Figure 2B:
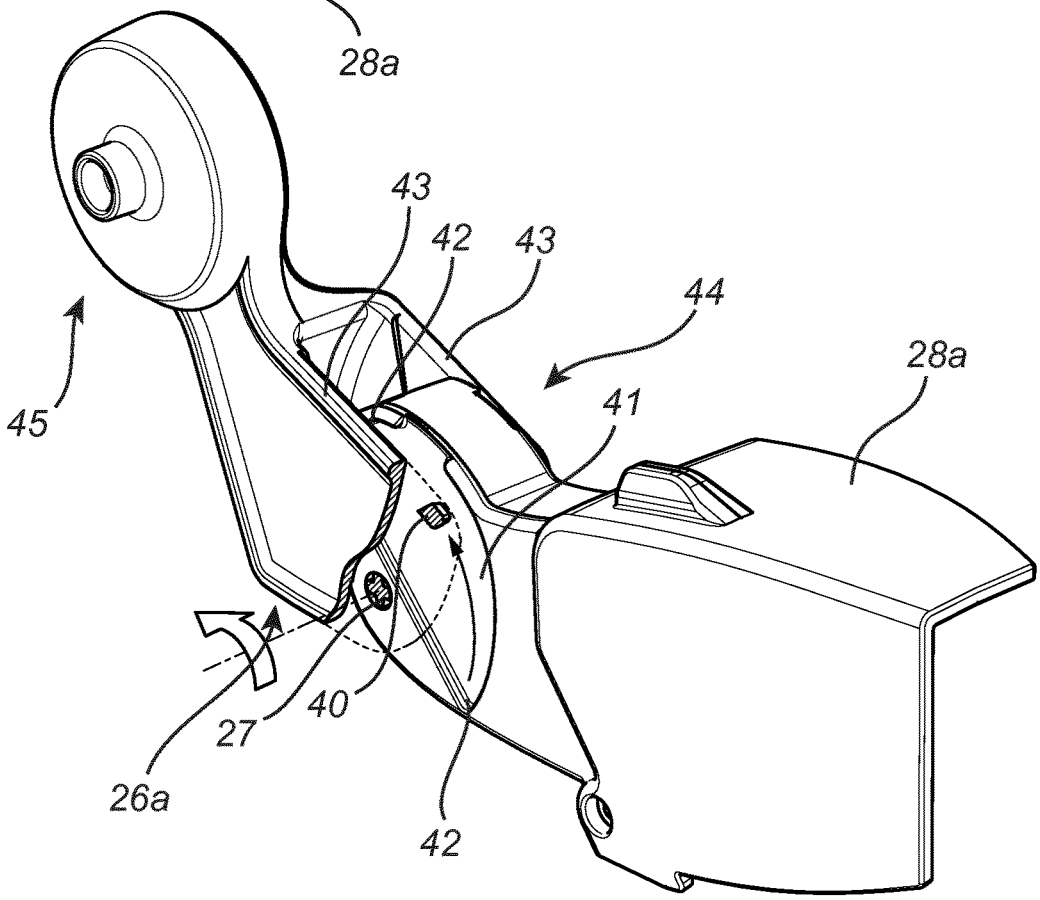

The two outer side surfaces 38 of the support member 28*a* each comprises a recess 41 and the bearing surfaces 39 of the first arm 26*a* each comprises a knob 40. The recess 41 is an area extending in a semi-circular manner from the top front to the lower back of the outer side surface. The bearing surfaces 39 bear against the outer side surfaces 38 as the arm 26*a* is moved between first and second position, and the knobs 40 slide in the complementary recesses 41 in order to guide the movement. In FIG. 2B the arm is in motion between its first and second position. Each recess 41 has an extension with closed end positions 42, and the knobs 40 slide in the recesses 41 between the closed end positions 42. The knobs 40 arranged in the closed end positions 42 of the recesses 41 corresponds to the first and second position of the first arm 26*a*, thereby positioning the first spindle 13*a* in dispensing and loading position respectively.

Figure 2C:
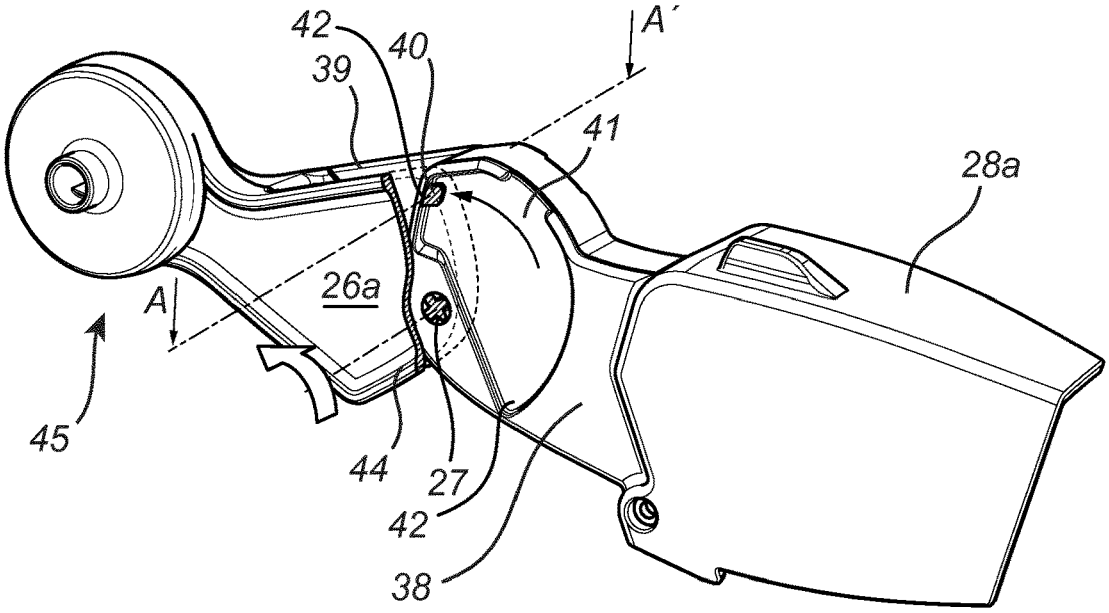

In FIG. 2C the first arm 26*a* is in its second position, folded outwards from the dispenser 11 interior, and the first spindle 13*a* is arranged in loading position.

Figure 2D:
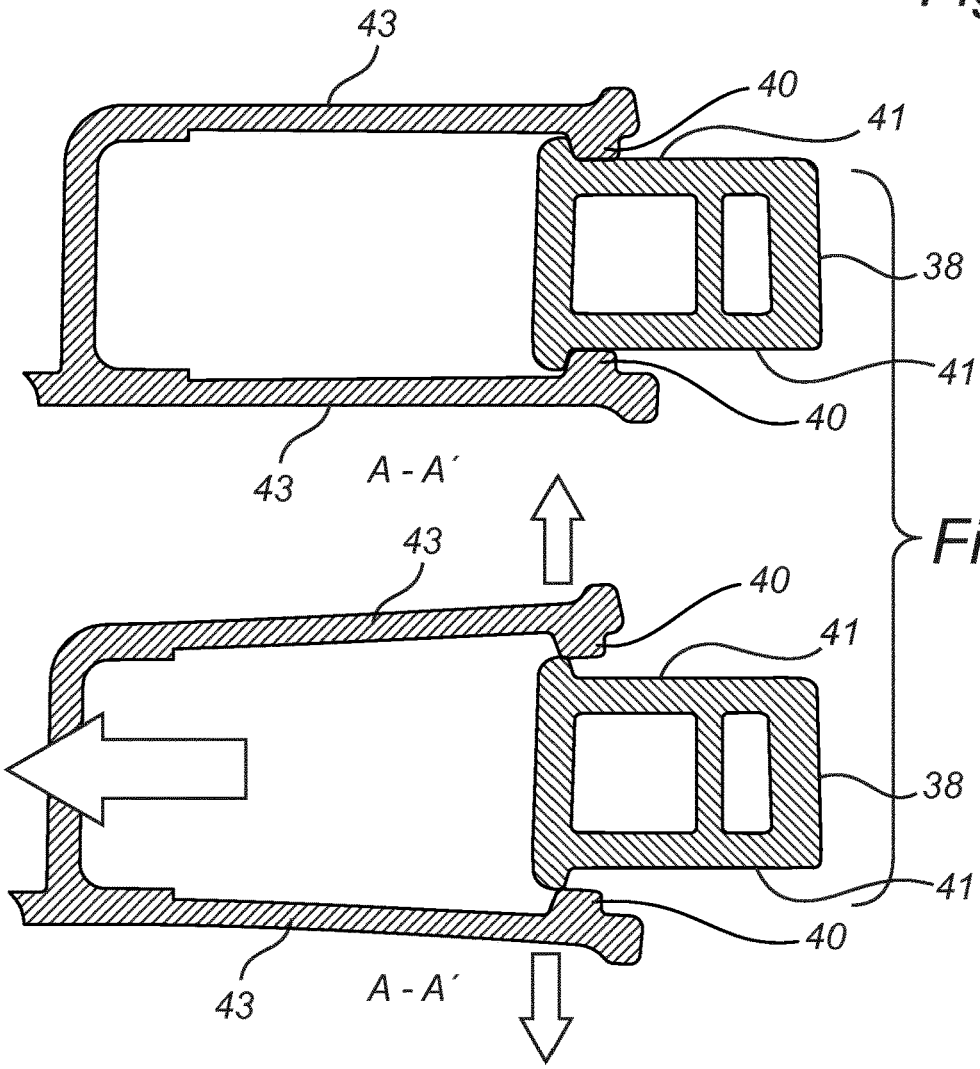
Figure 2E:
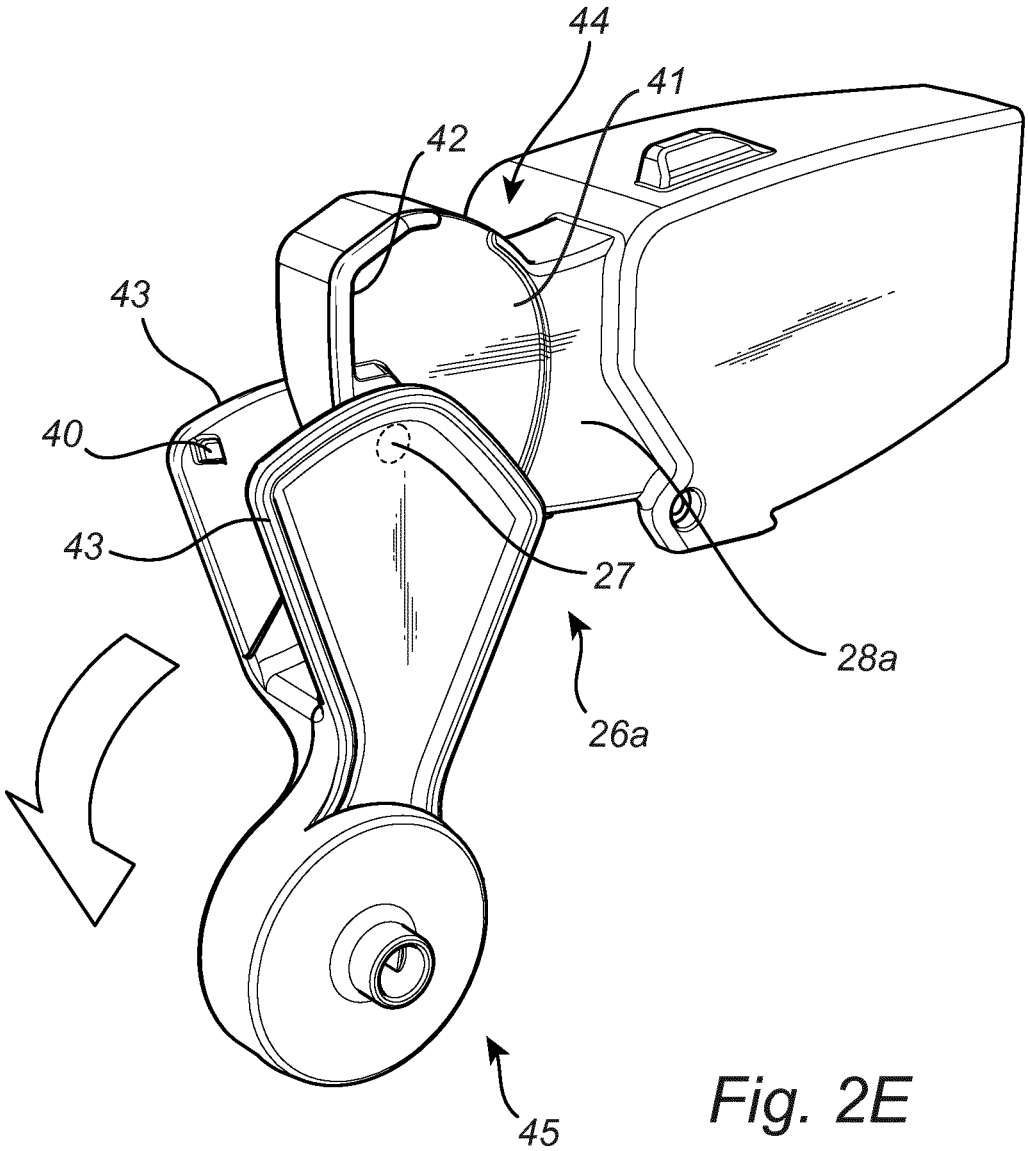

In FIG. 2E the first arm 26*a* is positioned in a third position hanging downwards. The third position is reached by an overload mechanism 40, 41 allowing the knobs 40 to snap out of the recesses 41 if a force above a predetermined release force is placed on the first spindle 13*a*. The snap out is shown in FIG. 2D, illustrating the legs 43 flexing outwards to allow the knobs 40 to pass the edge of the recesses 41. In FIG. 2E the knobs 40 has completely snapped out of the recesses 41 such that the first arm 26*a* has left its second position and rotated further about the hinge point 27 into its third position.

The second arm 26*b* and second support member 28*b*, not shown in FIGS. 2A-E, comprises the same elements as the first arm 26*a* and first support member 28*a*, and facilitate pivoting between first and second position in the same way. The overload mechanism may be present also between the second arm 26*b* and support member 28*b*.

A deflecting member 14 is arranged in the central side wall 222 of the housing 12. The deflecting member 14 is movable between a protruding position protruding towards the first spindle 13*a* in dispensing position, shown in FIG. 3A, and a retracted position retracted into the central side wall 222 of the housing 12 away from the spindle 13*a* in dispensing position, shown in FIG. 3B.

A receiving part 34 is arranged at the second side wall 223 and interacts with the first end 17 of the second spindle 13*b* in dispensing position. The receiving part 34 have the same frustoconical shape as the deflecting member 14.

Figure 3A:
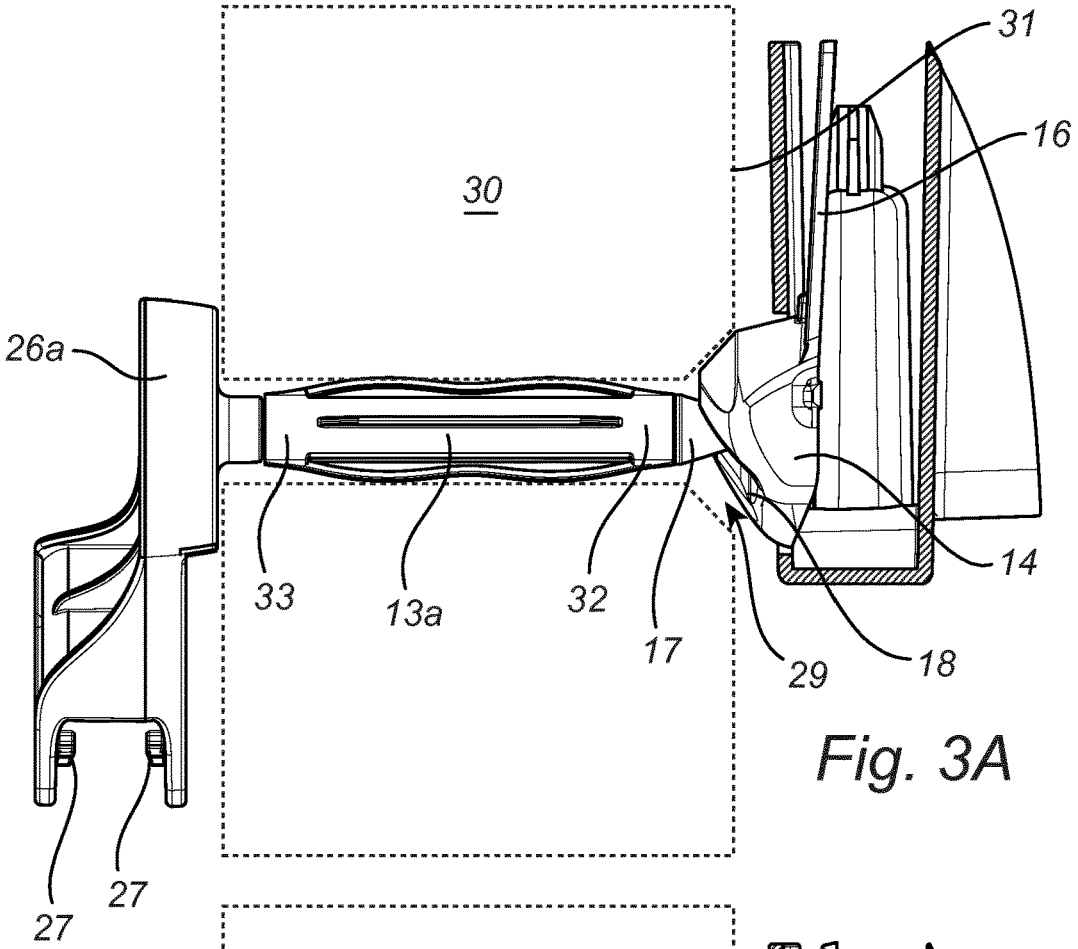
FIG. 3A is a perspective view of the deflecting member in protruding position.

The deflecting member 14 is connected to a resilient arm 16 connecting the deflecting member 14 to the central side wall 222 of the housing 12. In protruding position the deflecting member 14 is protruding from the side surface of the central side wall 222, protruding into the interior of the housing 12. In FIG. 3A a roll 30 having an indentation 29 at a first side 31 positioned at the first end 17 of the first spindle 13*a* is provided on the first spindle 13*a*. The indentation 29 is complementary to the frustoconical shape of the deflecting member 14 thereby allowing the deflecting member 14 to protrude into the indentation 29. No force is exerted on the deflecting member 14 and the resilient arm 16 is in relaxed state. The deflecting member 14 is in protruding position and the first spindle 13*a* is in the dispensing position. The first end 17 of the first spindle 13*a* is engaged in the deflecting member 14.

Figure 3B:
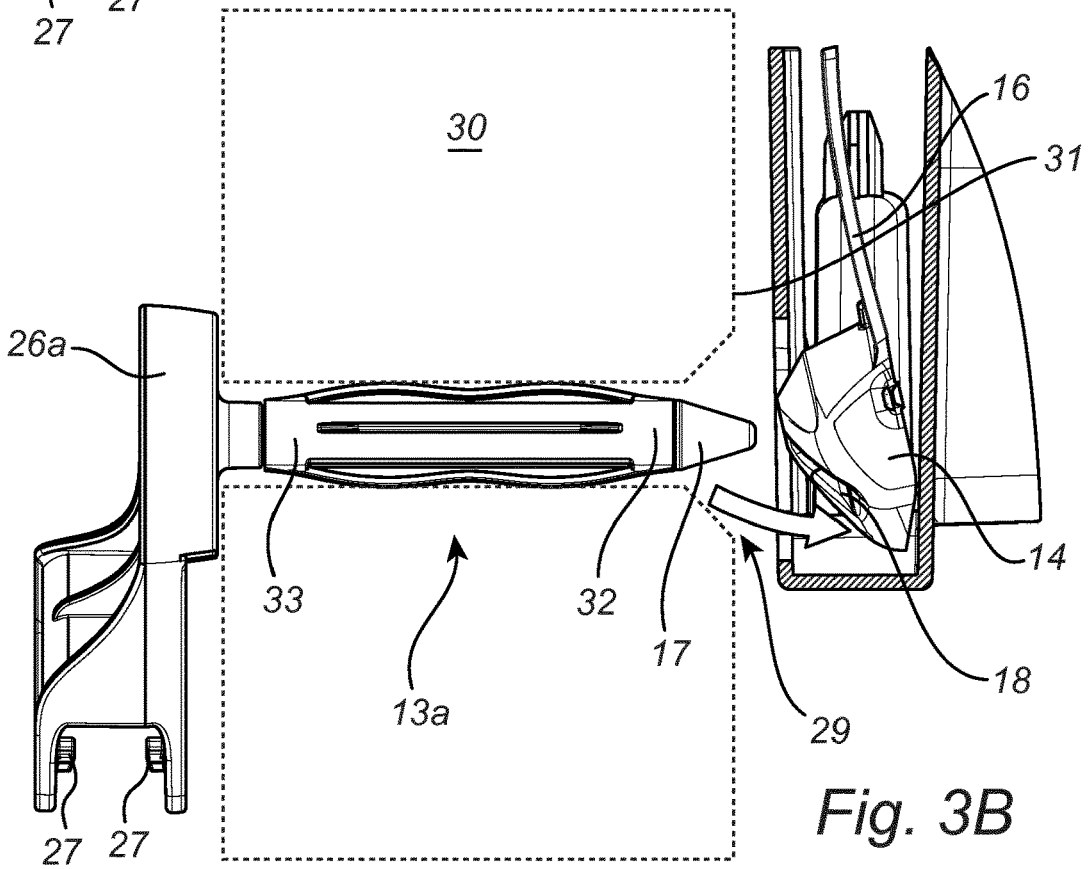
FIG. 3B is a perspective view of the deflecting member in retracted position.

If a force is applied to the deflecting member 14 the resilient arm 16 bends and the deflecting member 14 moves into its retracted position inside the central side wall 222, shown in FIG. 3B. This happens for example when the spindle 13*a* holding the roll 30 moves from loading to dispensing position and the side 31 of the roll 30 abuts the deflecting member 14. Once the spindle 13*a* is in dispensing position the force is removed due to the indentation 29 arranged adjacent the through hole in the side 31 of the roll 30, i.e. the tension on the resilient arm 16 is released and the deflecting member 14 flexes back into protruding position, shown in FIG. 3A.

If the roll 30 does not have a complementary shape indentation 29, or if the roll 30 is placed with the indentation 29 facing the second end 33 of the spindle 13*a*, the deflecting member will stay in retracted position.

The receiving part 34 having the same shape as the deflecting member 14 fits in an indentation 29 in a roll 30 being complementary to the shape of the deflecting member 14. It is movable between a protruding position and a retracted position.

Figure 4:
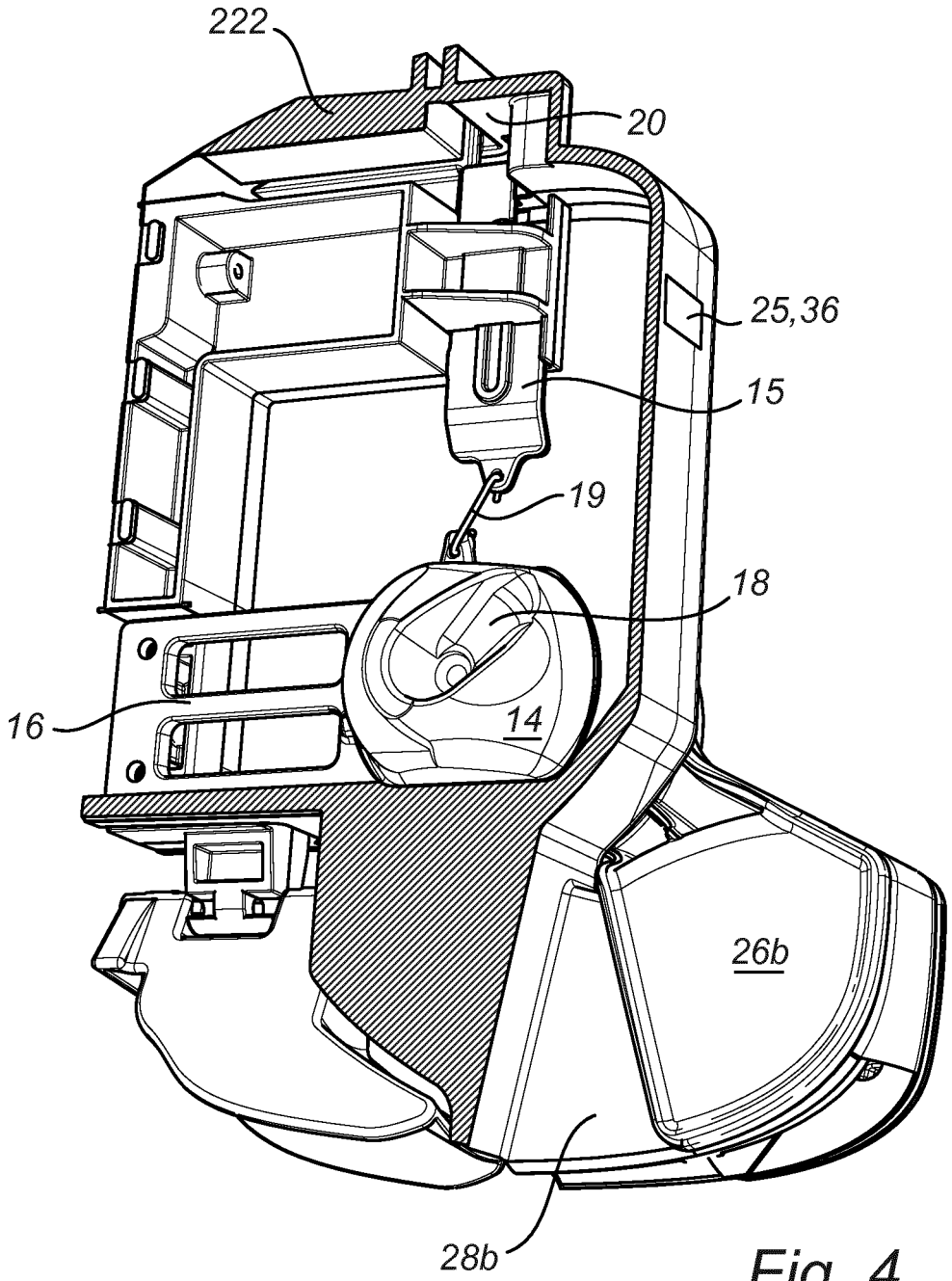
FIG. 4 is a cross-sectional view of the central side wall.

The central side wall 222 of FIGS. 1A-B is shown in FIGS. 4-5. Shown in FIG. 4; the deflecting member 14 is connected to a blocking member 15 by a rod 19 translating a horizontal movement of the deflecting member 14, between protruding position and retracted position in the central side wall 222, into vertical movement of the blocking member 15 moving it in and out of an engagement slot 20 in the central side wall 222 at the top wall 21.

Figure 5A:
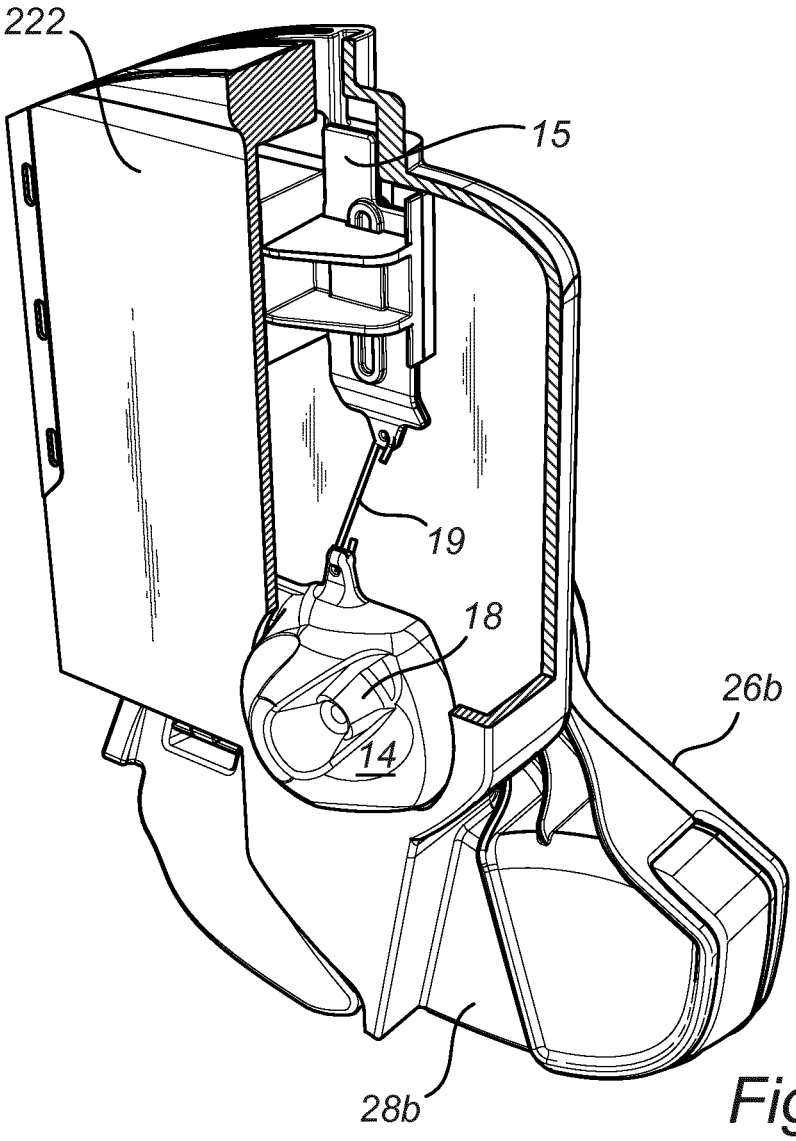
FIGS. 5A-B is a partly cross-sectional view of the central side wall with the deflecting member in protruding position and retracted position respectively.
Figure 5B:
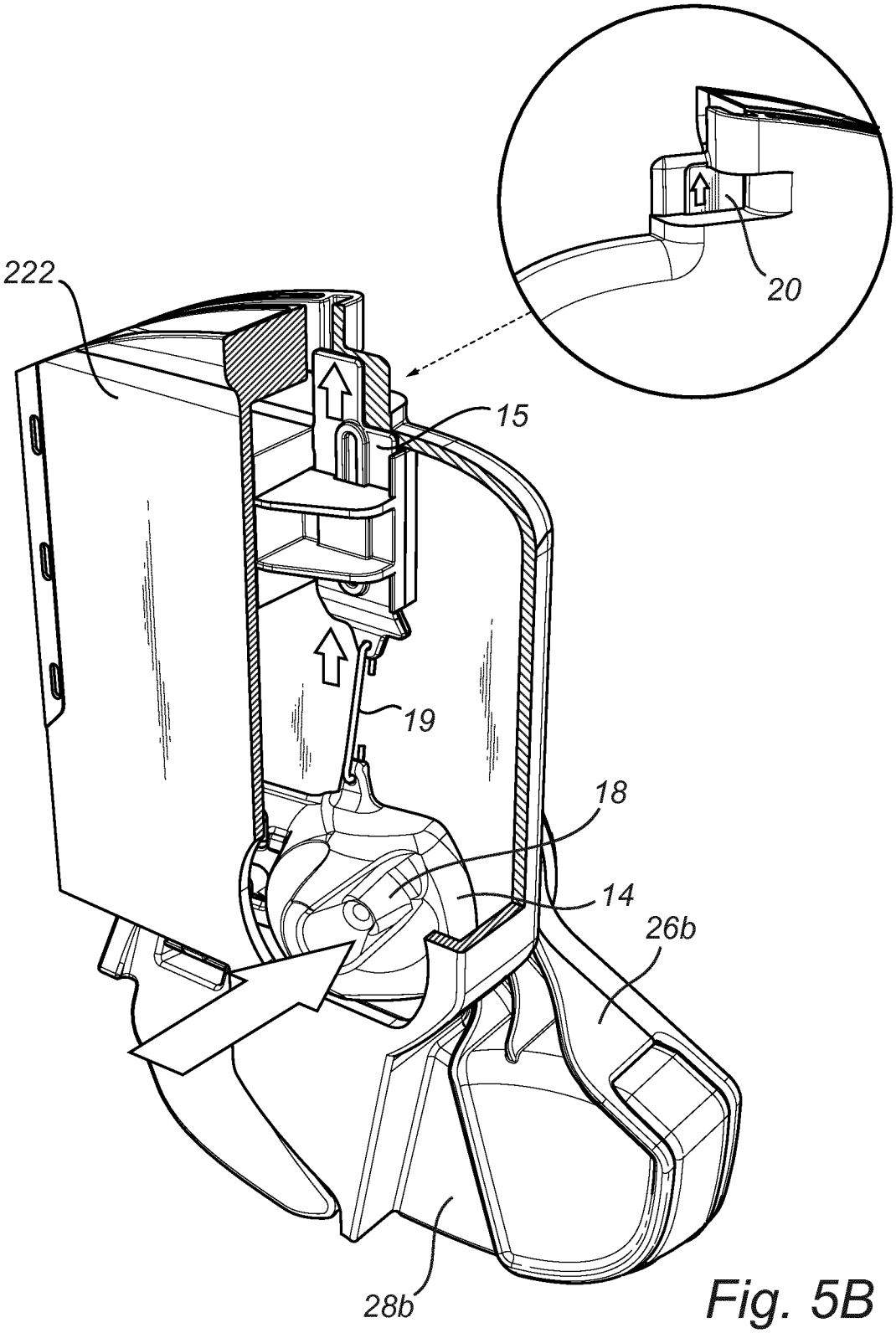

In FIG. 5A the deflecting member 14 is in protruding position, and the blocking member 15 is out of blocking position thereby not blocking the engagement slot 20 (seen in FIG. 4). The engagement slot 20 is thus available for the locking hook 24 of the front cover 23 to engage with, and the front cover 23 can thus be maintained and locked in closed position. In FIG. 5B the deflecting member 14 is pushed into retracted position, the resilient member 16 is tensed, the blocking member 15 is pushed upwards into the engagement slot 20 by the rod 19 and the engagement slot 20 is thereby blocked. The front cover 23 is unable to stay in closed position since the locking hook 24 cannot engage with the blocked engagement slot 20.

A color indication 36 is visible in an indication window 25, shown in FIGS. 1A-B, when the blocking member 15 is blocking the engagement slot 20. The indication 36 moves in and out of the indication window 25 with the movement of the blocking member 15 in and out of blocking position in the engagement slot 20. The indication 36 indicates to the service personnel if it is possible to lock the front cover 23 in closed state or not, thereby indicating if the roll 30 is correctly loaded or not.

Figure 6A:
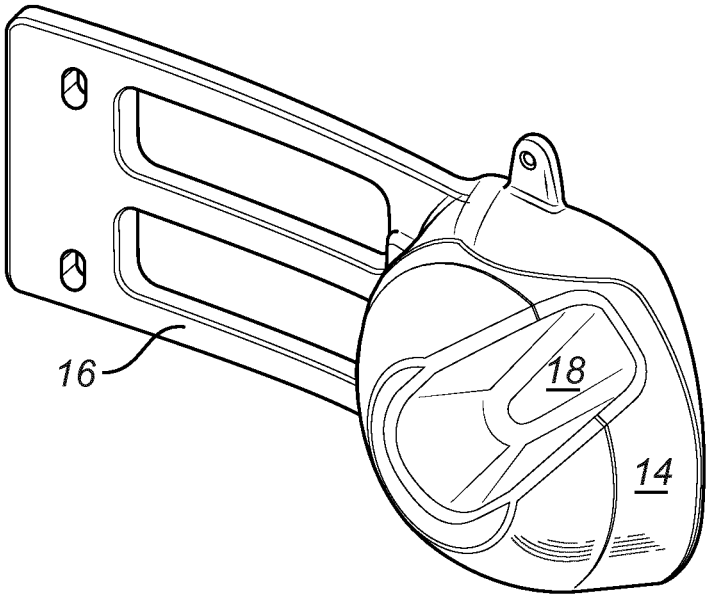
FIGS. 6A-B is a perspective view of the deflecting member and resilient member.
Figure 6B:
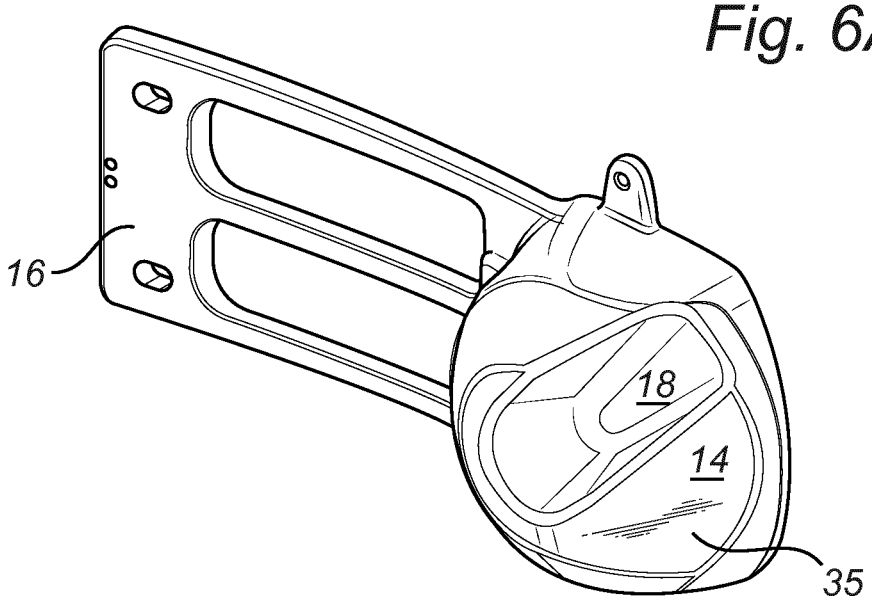

FIG. 6A shows a deflecting member 14 of truncated frustoconical shape comprising a guiding groove 18. The guiding groove 18 is adapted to receive the first end 17 of the first spindle 13*a* and guide it into an engaged position in the deflecting member 14 when the first spindle 13*a* is in dispensing position. In FIG. 6B the frustoconical shape is chamfered at one side to facilitate the edge of the first side 31 of the roll arranged on the spindle 13*a* to pass the deflecting member 14 when moved to dispensing position. The chamfered surface 35 is facing outwards from the interior of the housing 12, thereby facing the first end 17 of the first spindle 13*a* as it moves from loading position to dispensing position.

The invention claimed is:

1. A dispenser for dispensing web material from a roll, the dispenser comprising:

a housing defining an interior of the dispenser, said housing comprising a back wall and at least two side walls, an arm hinged at a hinge point on a support member, said arm being adapted to pivot about said hinge point, said arm comprising a spindle attached perpendicular to said arm, said spindle being adapted to rotatably support a roll during dispensing, and wherein said arm is pivotable about said hinge point between a first position in which said spindle is arranged in a dispensing position within the housing of the dispenser, and a second position in which said spindle is arranged in a loading position outside the housing of the dispenser in order to allow loading of a roll onto said spindle, wherein said spindle, when in dispensing position, is arranged closer to the back wall of the dispenser housing than the hinge point of the arm;

wherein a deflecting member is arranged in one of the at least two side walls of the dispenser housing, said deflecting member is arranged such that the deflecting member moves from a retracted position in the one of the at least two side walls to a protruding position toward the spindle, and the deflecting member includes a guiding groove configured to receive a first end of said spindle when said spindle is in dispensing position.

2. The dispenser according to claim 1, wherein said arm is folded over said support member in first position, and said arm is folded away from the support member in second position.

3. The dispenser according to claim 1, wherein said arm is pivotable from said first position within the interior of the dispenser into said second position.

4. The dispenser according to claim 1, wherein said support member is attached to the dispenser at a side wall of the dispenser.

5. The dispenser according to claim 1, wherein said support member and said arm extend in a direction perpendicular from the back wall of the dispenser, and wherein said arm is adapted to pivot in the same direction.

6. The dispenser according to claim 1, wherein the angle between said spindle in loading position and said spindle in dispensing position is at least 90 degrees.

7. The dispenser according to claim 1, wherein a portion of the deflecting member has a conical shape and the deflecting member is arranged such that the deflecting member moves from a retracted position in the one of the at least two side walls to a protruding position toward the spindle, and wherein the deflecting member includes a guiding groove in the conical portion that is configured to receive a first end of said spindle when said spindle is in dispensing position.

8. The dispenser according to claim 1, wherein said deflecting member comprises a guiding groove adapted to receive said first end of the spindle and guide it into an engaged position when the arm is in dispensing position.

9. The dispenser according to claim 1, wherein said deflecting member being movable between a protruding position protruding towards said spindle in dispensing position and a retracted position retracted into the housing away from the spindle in dispensing position; and wherein the deflecting member is connected to a blocking member moving in response to the movement of the deflecting member.

10. The dispenser according to claim 1, wherein said deflecting member interacts with a resilient member arranged to allow the deflecting member to flex back into protruding position from retracted position.

11. The dispenser according to claim 1, wherein said deflecting member has a shape adapted to fit in a complementary indentation in the side of a roll arranged on the spindle.

12. The dispenser according to claim 1, wherein the dispenser comprises a front cover and said front cover is hinged to the dispenser housing below the hinge point of the arm and movable between an opened and closed state, and wherein the front cover, upon being moved from opened to closed state, is adapted to abut against said arm if said arm is in second position and push said arm towards the first position with the movement of the front cover.

13. The dispenser according to claim 1, wherein at least one of the two side walls including a hollow portion, and the deflecting member is arranged such that the deflecting member moves from a retracted position within the hollow portion of the at least one of the two side walls to a protruding position toward the spindle, and the deflecting member.

14. The dispenser according to claim 1, wherein said arm partly encompasses part of the support member when the arm is in first position.

15. The dispenser according to claim 1, wherein said arm comprises two bearing surfaces, said bearing surfaces bear against the outer side surfaces of the support member such that said bearing surfaces are allowed to slide against the outer side surfaces of the support member when the arm moves between first position and second position.

16. The dispenser according to claim 1, wherein the dispenser is a dual dispenser comprising two support members, two arms and two spindles adapted to hold a roll respectively, and wherein the two arms are movable between first position and second position independent of each other.

17. The dispenser according to claim 1, wherein the dispenser is a dual dispenser comprising a support member, an arm and two spindles adapted to hold a roll respectively, and wherein the two spindles are attached perpendicular to said arm.

18. A dispenser for dispensing web material from a roll, the dispenser comprising:

a housing defining an interior of the dispenser, said housing comprising a back wall and at least two side walls, an arm hinged at a hinge point on a support member, said arm being adapted to pivot about said hinge point, said arm comprising a spindle attached perpendicular to said arm, said spindle being adapted to rotatably support a roll during dispensing, and wherein said arm is pivotable about said hinge point between a first position in which said spindle is arranged in a dispensing position within the housing of the dispenser, and a second position in which said spindle is arranged in a loading position outside the housing of the dispenser in order to allow loading of a roll onto said spindle, wherein said spindle, when in dispensing position, is arranged closer to the back wall of the dispenser housing than the hinge point of the arm;

wherein the arm comprises an overload mechanism allowing said arm to snap out of second position and rotate further about the hinge point to a third position that is further away from the back wall than the second position if a force above a predetermined release force is applied to the spindle when the arm is in second position.

19. The dispenser according to claim 18, wherein a deflecting member is arranged in the dispenser housing, said deflecting member being arranged to receive a first end of said spindle when said spindle is in dispensing position.

20. A dispenser for dispensing web material from a roll, the dispenser comprising:

a housing defining an interior of the dispenser, said housing comprising a back wall and at least two side walls, an arm hinged at a hinge point on a support member, said arm being adapted to pivot about said hinge point, said arm comprising a spindle attached perpendicular to said arm, said spindle being adapted to rotatably support a roll during dispensing, and wherein said arm is pivotable about said hinge point between a first position in which said spindle is arranged in a dispensing position within the housing of the dispenser, and a second position in which said spindle is arranged in a loading position outside the housing of the dispenser in order to allow loading of a roll onto said spindle, wherein said spindle, when in dispensing position, is arranged closer to the back wall of the dispenser housing than the hinge point of the arm;

wherein said arm comprises two bearing surfaces, said bearing surfaces bear against the outer side surfaces of the support member such that said bearing surfaces are allowed to slide against the outer side surfaces of the support member when the arm moves between first position and second position; and wherein at least one outer side surface of the support member is provided with a knob or recess and at least the corresponding bearing surfaces of said arm is provided with a complementary recess or knob, wherein said knob is allowed to slide along said recess as the arm moves between first position and second position.

21. The dispenser according to claim 20, wherein the knob(s) snap out of the recess(es) if a force above a predetermined release force is applied to the spindle when the arm is in second position.

22. A method of loading a dispenser for dispensing web material from a roll, the dispenser comprising a housing, said housing comprising a back wall and at least two side walls, an arm hinged at a hinge point on a support member, said arm being allowed to pivot about said hinge point, and the dispenser further comprising a spindle attached perpendicular to said arm, and a deflecting member arranged in one of the at least two side walls of said housing, the deflecting member is arranged such that the deflecting member moves from a retracted position in the one of the at least two side walls to a protruding position toward the spindle, and wherein the deflecting member includes a guiding groove configured to receive a first end of said spindle when said spindle is in dispensing position, said spindle being adapted to rotatably support a roll during dispensing, and the method of loading comprises:

pivoting said arm about said hinge point to a second position in which the spindle is arranged in a loading position outside the housing of the dispenser thereby allowing loading of a roll onto said spindle, placing a roll on said spindle, and pivoting said arm about said hinge point back into a first position, in which the spindle is arranged in a dispensing position within the housing of the dispenser, wherein said spindle, when in the dispensing position, is arranged closer to the back wall of the dispenser housing than the hinge point of the arm, when the arm is pivoted into the first position, the spindle engages the deflecting member in the dispenser housing, and said deflecting member receives a first end of said spindle in the guiding groove when said spindle is in dispensing position.

23. The method of loading a dispenser according to claim 22, wherein said arm is folded away from the support member when pivoted to said second position, and said arm is folded back towards the support member when pivoted into said first position.

24. The method of loading a dispenser according to claim 22, wherein the dispenser further comprises a front cover hinged to the dispenser housing below the hinge point of the arm and arranged to be movable between an opened and closed state, wherein the method further comprises:

moving the front cover to said opened state before pivoting the arm into second position, moving the front cover from said opened state to said closed state after a roll has been placed on said spindle, and pushing the front cover against said arm in second position, said arm thereby being urged to fold towards the first position with the movement of the front cover.

25. The method according to claim 22, wherein at least one of the two side walls including a hollow portion, and the deflecting member is arranged such that the deflecting member moves from a retracted position within the hollow portion of the at least one of the two side walls to a protruding position toward the spindle, and the deflecting member.

26. The method according to claim 22, wherein a portion of the deflecting member has a conical shape and the deflecting member is arranged such that the deflecting member moves from a retracted position in the one of the at least two side walls to a protruding position toward the spindle, and wherein the deflecting member includes a guiding groove in the conical portion that is configured to receive a first end of said spindle when said spindle is in dispensing position.

* * * * *